US012655984B1

(12) United States Patent
Spampinato, Jr.

(10) Patent No.: US 12,655,984 B1
(45) Date of Patent: Jun. 16, 2026

(54) FIRE PIT LINER AND METHOD OF USING THE SAME

(71) Applicant: Francis Cesidio Spampinato, Jr., Leesburg, VA (US)

(72) Inventor: Francis Cesidio Spampinato, Jr., Leesburg, VA (US)

( * ) Notice: Subject to any disclaimer, the term of this patent is extended or adjusted under 35 U.S.C. 154(b) by 374 days.

(21) Appl. No.: 18/457,632

(22) Filed: Aug. 29, 2023

Related U.S. Application Data

(60) Provisional application No. 63/411,552, filed on Sep. 29, 2022.

(51) Int. Cl.
*F24B 1/195* (2006.01)
*F24B 13/00* (2006.01)
*F24B 13/02* (2006.01)

(52) U.S. Cl.
CPC ..... *F24B 13/02* (2013.01); *F24B 13/006* (2013.01)

(58) Field of Classification Search
CPC ..... F24B 13/02; F24B 13/006
USPC ..... 126/65
See application file for complete search history.

(56) References Cited

U.S. PATENT DOCUMENTS 2,824,534 A * 2/1958 Joseph ..... D05B 13/00 112/475.08
3,424,145 A * 1/1969 Lou ..... A47J 37/0786 126/25 R
3,601,280 A 8/1971 Mills
4,454,611 A * 6/1984 Tschirch ..... A41D 19/01529 2/167
4,828,134 A * 5/1989 Ferlanti ..... A47G 19/03 220/573.1
4,938,202 A 7/1990 Hait
6,101,931 A 8/2000 Miklos
6,918,387 B2 7/2005 Klarich et al.
7,163,120 B1 * 1/2007 Blucher ..... A47J 36/16 220/573.4
8,028,690 B1 10/2011 Lohaus
10,040,613 B2 * 8/2018 Radosta ..... B65D 25/16
10,151,490 B1 * 12/2018 Wolf ..... F24B 1/1808
D858,739 S 9/2019 Hume
2004/0107954 A1 6/2004 Biluk et al.
2008/0159665 A1 * 7/2008 Callies ..... B65D 31/00 383/105
2009/0283092 A1 11/2009 Malone

* cited by examiner

*Primary Examiner* — Avinash A Savani

(74) *Attorney, Agent, or Firm* — John Rizvi; John Rizvi, P.A.—The Patent Professor ®

(57) ABSTRACT

A fire pit liner is provided herein. The fire pit liner can comprise a non-flammable material liner in a non-expandable uniform circular bowl-shape which is collapsible into the form of a bag. There is also provided a method of operating a fire pit employing the fire pit liner. The method can comprise providing a fire pit, providing the fire pit liner of the invention to the fire pit, conducting a fire in the fire pit, and collapsing the fire pit liner into the form of a bag, and optionally disposing of the bag.

18 Claims, 8 Drawing Sheets

FIRE PIT LINER AND METHOD OF USING THE SAME

CROSS-REFERENCE TO RELATED APPLICATIONS

This application claims the benefit of U.S. Provisional Patent Application Ser. No. 63/411,552, filed on Sep. 29, 2022, which is incorporated by reference herein it is entirety.

FIELD OF THE INVENTION

The present invention relates generally to the field of fire pits. More particularly, the present invention relates generally to cleaning of fire pits.

BACKGROUND OF THE INVENTION

Fire has been a source of interest for man since the earliest days of civilization. Fire has from ancient times had the common uses of protection from dangerous animals, providing warmth, providing light after dark to conduct other activities, and for cooking food. In addition, fire pits have existed almost as long as the invention of fire. The earliest fire pits were holes dug into the ground, or stones placed around the fire to prevent its spread.

In addition to the historic uses of fire and fire pits, fire has always held a pleasant aesthetic appearance and has been a source of social gathering for many. Thus, fire pits have been continuously used and have evolved into various forms overtime. While firepits can still comprise holes in the ground dug by outdoorsmen, they have also extended to elegant modern symbols of luxury for patios and gardens that employ diverse materials such as brick, stone, metal, glass and other materials.

The more elaborate fire pits can be fueled by hidden sources of gas or by electricity to provide a natural looking flame that is pleasant and welcoming. However, many gas powered and electric fire pits tend to produce little heat. The reason being that these fire pits are designed for appearance more than for providing warm to those gathered around it. Gas and electric fires, due to their consistent source of fuel/power are also usually only constructed so as to only provide a dim glow or a low flame. This is done so as to avoid transference of the fire to surrounding materials.

While many firepits can be very extravagant, plenty of firepits are still constructed in a more rustic manner to be used to burn wood or other burnable materials, such as kerosene-soaked compacted logs. Such firepits can be constructed of more readily available and cost-effective materials such as steel, aluminum, ceramic and the like. They can be elevated off the ground or be at ground level. Contrary to gas-fueled or electric fire pits, the burning of wood in a fire pit provides for a continuing chemical reaction that releases a great deal of heat by breaking down the chemical bonds of the compounds present in the wood. This is what explains the different colors and hues of the flames and the aroma being provided by the burning of the particular type and age of wood. In addition, burning wood can be controlled in terms of its flame height by limiting the amount of wood fuel provided to the fire.

One of the problems with burning wood in a fire pit as opposed to a gas or electric fire pit is that the burning reaction produces a great deal of residue in terms of ash. Such ash is messy and difficult to easily remove from a fire pit. Usually, one is required to scoop it out or to tilt the fire pit on its side to completely remove the ash material.

Scooping out the ash or tilting the fire pit can result in spilt ash which can stain the surrounding floor.

Still further, the burning of wood in a fire pit can stain and damage the burning area of the fire pit. While fire pits are made of non-flammable materials, the fire pit is usually coated with an attractive surface layer of ceramic, metal or paint and the like. While these materials are non-flammable, they are very prone to discoloration even after one or more uses. Further, the continued and/or extended use of the fire pit to burn wood can result in the deterioration of the underlying metal.

One solution is to have a bottom surface of the fire pit to be openable with a hinged door type apparatus. This can provide for more effective removal of the ash from the fire pit, but such compromises the integrity of the bottom of the fire pit. Holes or misalignment of the door can produce avenues for the active fire to be dispelled therethrough during the use of the fire pit. This can risk a spread of the fire, or at least a staining of the underlying surface. Still further, such does not resolve the problem of the interior surface of the fire pit becoming stained and/or deteriorated over time.

Accordingly, there remains a need for a solution to at least one of the aforementioned problems. For instance, there is an established need for a way to avoid the discoloration and/or deterioration of a wood burning fire pit and a manner of cleaning such a fire pit in a quick and non-messy way.

SUMMARY OF THE INVENTION

The present invention can be directed to a fire pit liner that can be used in wood-burning fire pits. The fire pit liner described herein prevents the interior wood-burning area of the fire pit from being discolored and/or deteriorated over time by the burning of wood, and simultaneously provides for a quick and easy cleanup of the remaining ash and residue of the fire.

In a first implementation of the invention there can be provided herein a fire pit liner comprising a non-flammable material liner in a non-expandable uniform circular bowl-shape which is collapsible into the form of a bag In one aspect of the invention, the non-flammable material of the fire pit liner can be made of a material selected from the group consisting of metal, glass and ceramic. Preferably, the non-flammable material of the fire pit liner can be metal or metal alloy, such as aluminum, steel, copper, tin and the like. More preferably, the metal is a metallic paper made of tempered aluminum foil having a thickness within the gauge range of 0.001 inches to 0.005 inches. The tempering is in the range of 50% to 100%. Other metallic paper foils may be suitable, such as copper foil and stainless-steel foil.

In another aspect of the invention, the fire pit liner can be circular, preferably a circular shape that conforms to the circular shape of common backyard fire pits. The circular shape of the fire pit liner can be the same as or bigger than the shape of the fire pit to which it is to be applied. Preferably, the liner is larger in diameter than the fire pit to which it is to be applied. Some suitable circular sized fire pit liners can be those having a diameter of from about 12 inches to about 96 inches, preferably from about 24 inches to about 72 inches, and more preferably from about 36 inches to about 48 inches. Most preferably the diameter of the expandable fire pit liner can be from about 2 to about 6 inches, more preferably from about 3 to 4 inches longer than the diameter of the underlying fire pit. Such can be larger to provide for expanding the fire pit liner to the desired depth as described herein, and/or to accommodate wrapping the circumference of the fire pit liner around a circumference of the edge of the underlying fire pit.

In yet another aspect of the invention, the fire pit liner can be of a flat metal paper of a circular shape that can formed into the non-expandable uniform circular bowl-shaped fire pit liner of the present invention. In one embodiment, the size of the non-expandable uniform circular bowl-shaped fire pit liner can be of a depth of from about 2 inches to about 12 inches, more preferably from about 3 inches to about 8 inches and most preferably from about 4 inches to about 6 inches; the depth being measured at the deepest point of the non-expandable uniform circular bowl-shaped fire pit liner.

The fire pit liner described herein can be of a shape, when formed such that it is of a circular bowl shape. One example of bowl-shaped is that it has a concavity which terminates at its deepest depth with a flat circular area. The flat circular area can be a circle with a diameter of from about 4 to about 8 inches, preferably from about 5 to 7 inches.

In one embodiment, the non-expandable uniform circular bowl-shaped fire pit liner described herein can be formed by hand by pressing down on a flat circular fire pit liner material so as to conform the liner material to the interior concave surface of the underlying fire pit. In another embodiment the pressing down on a flat circular fire pit liner material can produce a non-expandable uniform fire pit liner of a diameter and depth as described herein and which conforms to the concave shape of a corresponding fire pit. In one embodiment, the term "expanded" can be understood to mean that the uniform circular bowl-shaped fire pit liner described herein contains no folds or pleats, and as such, cannot be extended to cover more surface area of the firepit if stretched. Preferably, such an expanded fire pit liner can also have no holes, perforations, channels, or raised segments therein. The term "uniform" as described herein is understood to mean that the fire pit liner has no holes, perforations, channels, or raised segments therein, but such term does not apply to the optional presence of the threaded threading material as described herein below.

In a second implementation of the invention there can be provided herein a fire pit liner comprising a non-flammable material liner in a non-expandable uniform circular bowl-shape. Such a fire pit liner can have any of the aforementioned diameters and/or depth measurements. Thus, in this embodiment, the fire pit liner is already in a fixed non-expandable uniform circular bowl-shape, preferably a shape which conforms to the interior concavity of a circular fire pit, with no preexisting folds, pleats or the like. In such a non-limiting embodiment, the fire pit liner does not need to be formed by pressing it into the underlying fire pit and also cannot be expanded or stretched without damaging the liner. Preferably, such a non-expandable fire pit liner can be unadulterated, i.e., it can have no holes, perforations, channels, or raised segments therein or there below. Preferably such a non-expandable fire pit can conform in any one or more of an uniform, flush and consistent manner with the shape of the underlying fire pit.

In yet even another aspect of the invention, the underlying fire pit can have a wood burning area which is of a circular concave bowl shaped area, optionally with a flat circle area at bottom as described herein, which wood burning area is the area covered by the fire pit liner described herein. The fire pit area above, below or surrounding the wood burning area, can be of any size, configuration and of any material desired. The area surrounding the wood burning area can be a flat surface which is also circular, or can alternatively be any of, oval, triangular, square, rectangular, hexagonal, octagonal and the like. The surrounding flat area can be covered in a non-flammable material such as stone, tile, ceramic and the like. Preferably, the surrounding flat area can extend 2 to 12 inches from the border of the wood-burning area, more preferably, from about 4 to about 8 inches from the border of the wood-burning area.

In yet one other aspect of the invention, the wood-burning area of the fire pit can be nestled into the ground, or the entire fire pit can be elevated above the ground, preferably at an elevation of from about 2 to 3 feet off the ground. The fire pit can be elevated by any suitable number of legs, e.g., one central stand, or two stands, or three or four or more legs. The legs can be round, oval square or rectangular. In some embodiments each of the legs of the fire pit can bend down and inwardly toward the center of the fire pit and meet in a circular base ring which supports the fire pit. In one non-limiting embodiment, the fire pit can be used exclusively for ornamental and/or heating purposes outdoors. More preferably, the fire pit can be such that it is not used with any underlying heat or flame. Further, the fire pit liner does not have any perforations, ribs, or passages underneath or above the liner.

In yet even one other aspect of the invention, the fire pit liner can remain in the fire pit as a protective cover to the underlying surface of the wood burning area of the fire pit in between uses of the fire pit. The fire pit liner can also function to serve as a liner during use of the firepit.

In one other aspect of the invention, the uniform circular bowl-shaped fire pit liner described herein can be layered upon another underlying uniform circular bowl-shaped fire pit liner described herein in order to form a series of overlaid fire pit liners, the top layer of which can be removed after one or more uses of the fire pit to expose the next unused fire pit liner.

In one aspect of the invention, the fire pit liner can be collapsible into the form of a bag after use. Preferably prior to collapsing the fire pit liner one can remove any large items from the fire pit such as remaining unburned larger pieces of wood. Thereafter, if the fire has recently ended, e.g., within less than 8 hours, one can pour a suitable amount of water, e.g., 8 oz to 1 gallon, preferably from 16 to 32 oz of water into the fire pit liner so as to extinguish any remaining flame, ember or remaining combusting material.

In another aspect of the invention, fire pit liner can be collapsible by any suitable technique. Such can be accomplished in one embodiment by first removing any portion of the fire pit liner that may be beneath an edge of the underlying fire pit wood burning area. Then, since the fire pit liner is of a sufficiently pliable and flexible material, different points of the circular edge of the fire pit liner can be cinched together from two, three, four or more points along the circumference of the fire pit line to form a bag or pouch with the contents of the fire pit liner located therein in the cinched depth of the fire liner. Thereafter, the pouch can be discarded in an appropriate receptacle.

In yet another aspect of the invention, the fire pit liner can have a non-flammable threading material threaded through a smaller circumference of the fire pit liner material than the full circumference of the fire pit material, i.e., within an area within the circular edge of the fire pit liner, preferably within ½ an inch to 2 inches, preferably withing 1 inch to 1½ inches from the edge. Such an edge can be of an increased thickness and/or strength as compared to the thickness and strength of the fire pit material. In one embodiment, the threaded material can be the same as or different from the material of the fire pit liner. Preferably, the threading material can be a metal material in a wire form which is of an increased strength compared to the strength of the fire pit liner material. The threading material can be an aluminum, copper, steel, or brass wire of about 16-to-30-gauge wire, preferably which is not insulated with insulation. In another embodiment the threading material may be of a fire-resistant textile material such as rope or cord or made with any one or more of poly benzyl imidazole, aromatic polyamides, flame retardant cotton, coated nylon, phosphorus-containing natural or synthetic cords or ropes, melamine-containing cords or ropes, modacrylic cords or ropes and the like. Such cords or ropes can have a diameter of from about 1/32 of an inch to about 1/2 inch, preferably from about 1/8 of an inch to about 3/8 of an inch.

In yet even another aspect of the invention, the use of a threaded materials provides for an easy manner of cinching the fire liner closed to prevent escape of any remaining flammable materials and provides for easy disposal in the suitable trash receptacle.

In a third implementation of the invention there can be provided herein a method of operating a fire pit comprising:

(a) providing a fire pit;

(b) providing the herein described fire pit liner to the fire pit;

(c) conducting a fire in the fire pit; and, (d) collapsing the fire pit liner into the shape of a bag.

In one aspect of the invention, the step (b) of providing the fire pit liner described herein can comprise applying the flat circular metal paper material of the fire pit liner by pressing such material of the fire pit liner into the fire pit, e.g., by pressing into the underlying wood burning area of the fire pit by hand, and thus, straightening or expanding any folds, pleats and the like to a fully expanded fire pit liner such that it is flush with the surface of the underlying fire pit wood burning area. It will be understood herein that any such pressing of a flat circular shape of material into a concave circular bowl shape may result in folds or wrinkles in the circular metal paper material as it is being formed into the uniform circular bowl-shaped fire pit liner described herein. It will be understood herein that such folds or wrinkles do not constitute the folds or pleats which are excluded in the non-expandable, uniform circular bowl-shaped fire pit liner described herein.

In another aspect of the invention, the step (b) of pressing the circular fire pit liner flat metal paper material described herein can comprise pressing the circular fire pit liner flat metal paper material to the underlying fire pit, e.g., the underlying wood burning area of the fire pit, such that it is flush with the surface of the underlying fire pit wood burning area.

In yet another embodiment, the step (d) of collapsing the fire pit liner into the shape of a bag can comprise either cinching the circumferential edge points of the non-expandable, uniform circular bowl-shaped fire pit liner as described herein above, or alternatively, pulling the optional threaded threading material, e.g., the non-flammable metal wire or non-flammable cord or rope threaded in the edge of the fire pit liner, in order to cinch the fire pit liner with the depth of the fire pit liner containing the ash and debris from the fire forming a pouch. Thereafter, the fire pit liner as the pouch can optionally be discarded as is suitable.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1 and/or FIG. 3. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
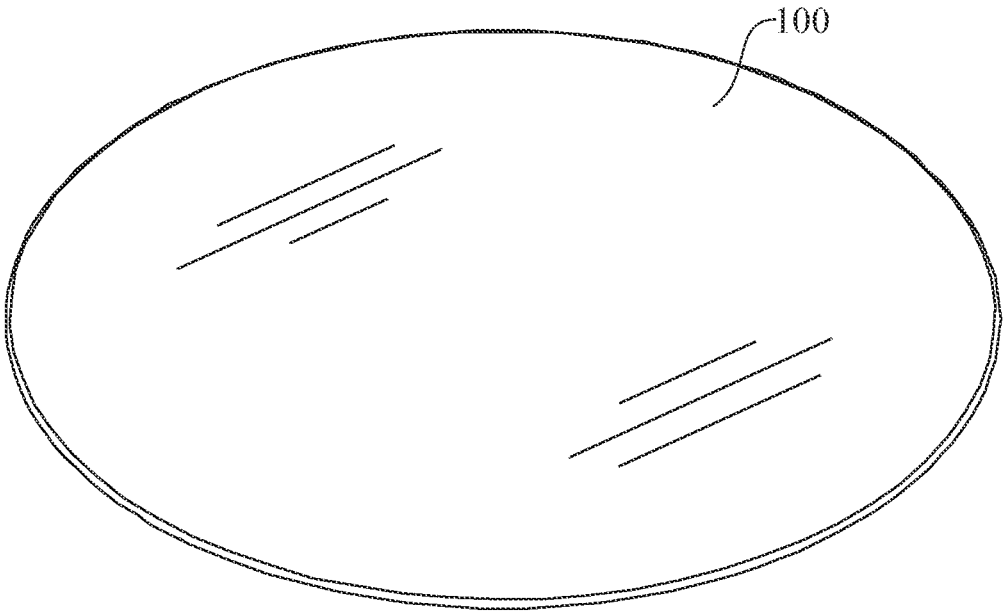
FIG. 1 present a perspective view of the fire pit liner of the present invention.

Referring initially to FIG. 1, there is shown the circular flat metal paper material 100 described herein.

Figure 2:
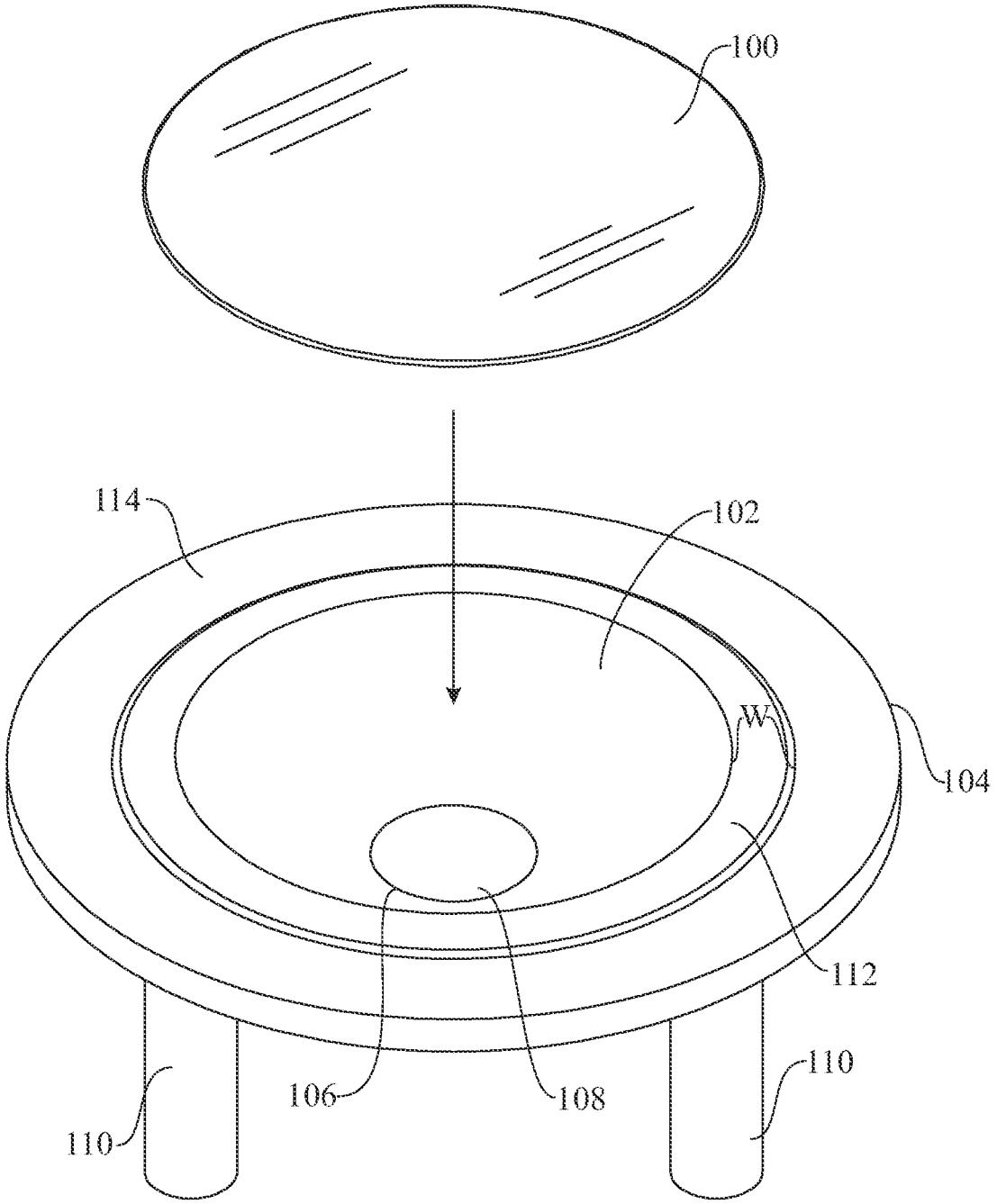
FIG. 2 presents a perspective view of the fire pit liner over a fire pit.
Figure 3:
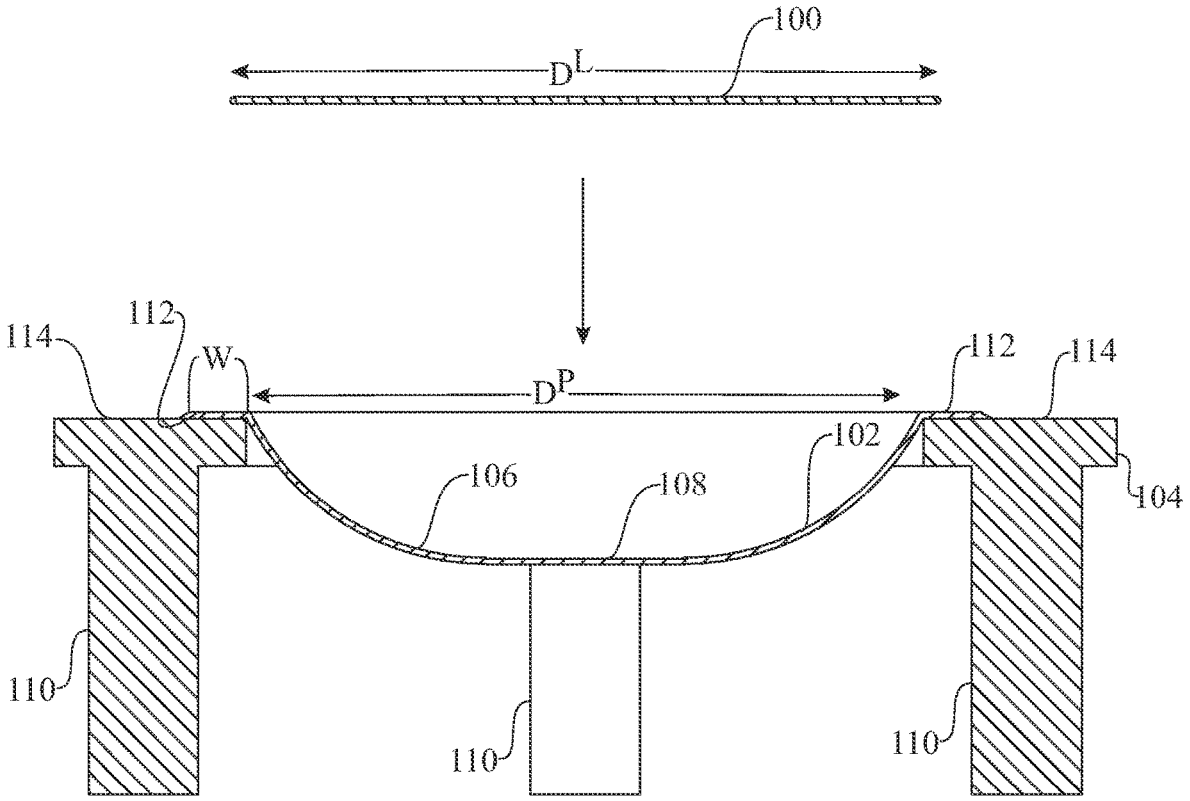
FIG. 3 presents a side cut away view of the fire pit liner and fire pit of FIG. 2.

Referring to FIGS. 2 and 3, there is provided the circular flat metal paper material 100 in its positioning above the woodburning area 102 of the firepit 104 prior to being pressed in the direction indicated by the downward arrow. The diameter of the liner $D^L$ is shown as being greater than the diameter of the woodburning area of the fire pit $D^P$. The fire pit 104 has at a bottom of the woodburning area 106 a flat circular area 108 which makes the wood burning area 102 into a circular bowl shape. The fire pit 104 is shown supported on two of three firepit legs 110. The woodburning area 102 has an overlying circular lip section 112 having a width "w". The area extending radially out beyond the circular lip section 112 is border edge section 114.

Figure 4:
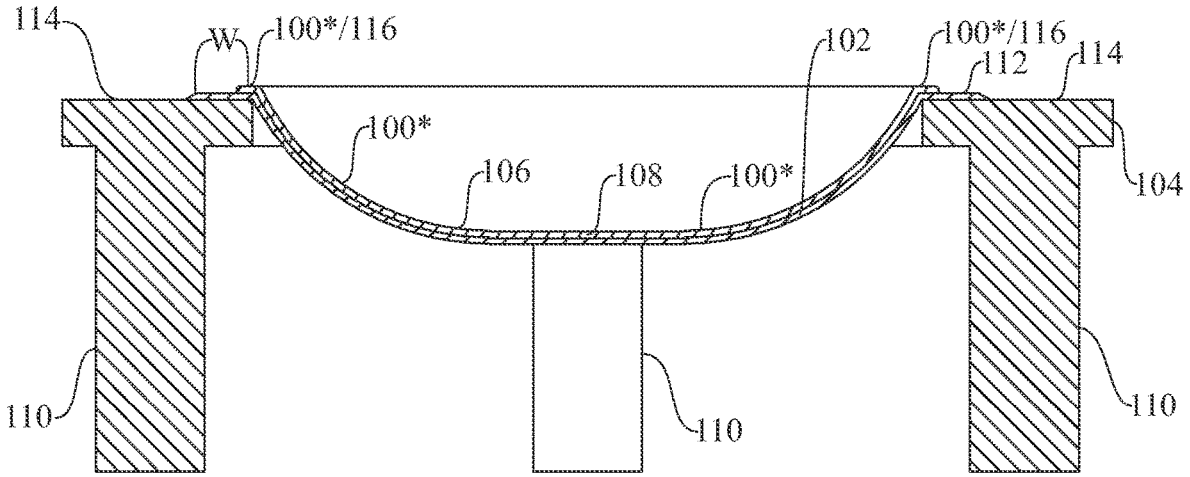
FIG. 4 presents a side cut away view of the fire pit liner placed in the fire pit.
Figure 5:
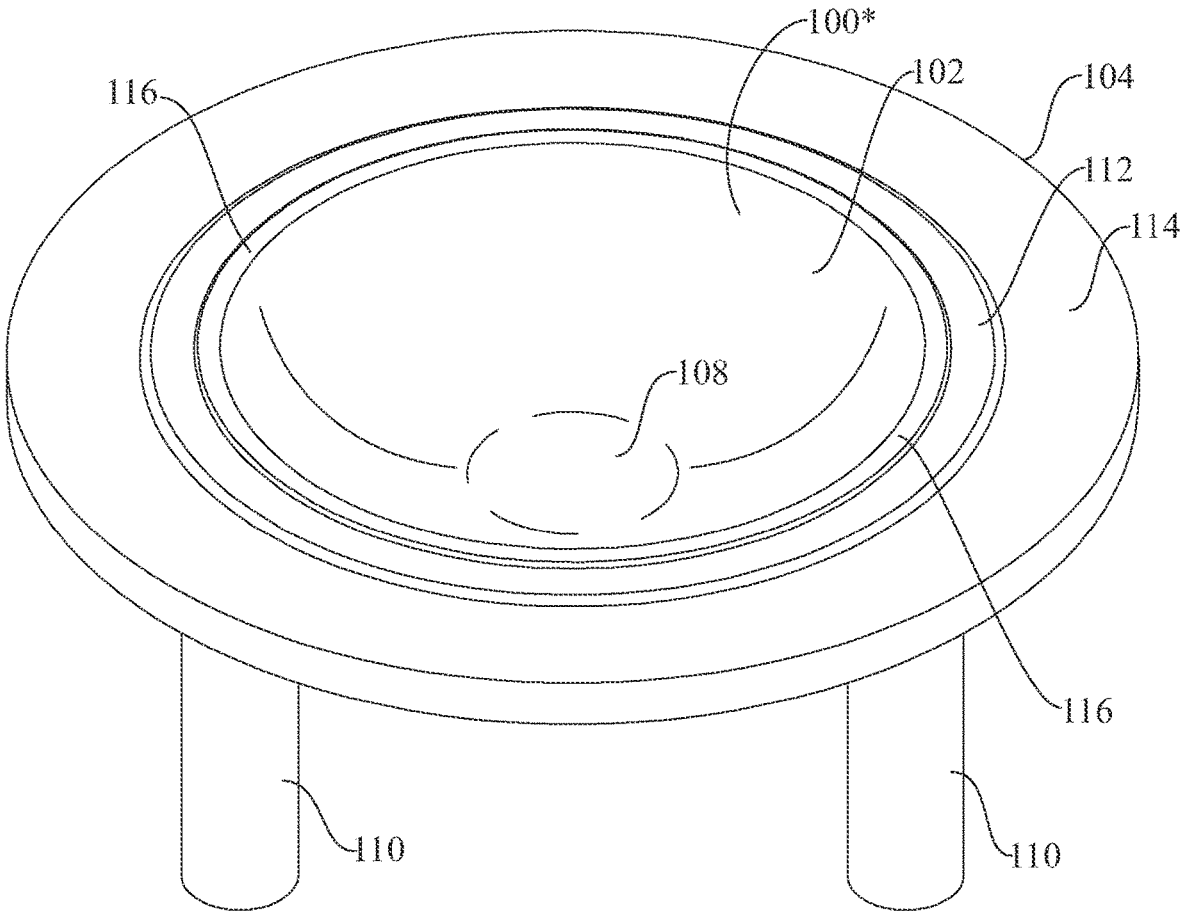
FIG. 5 presents a perspective view of the fire pit liner in the fire pit.
Figure 6:
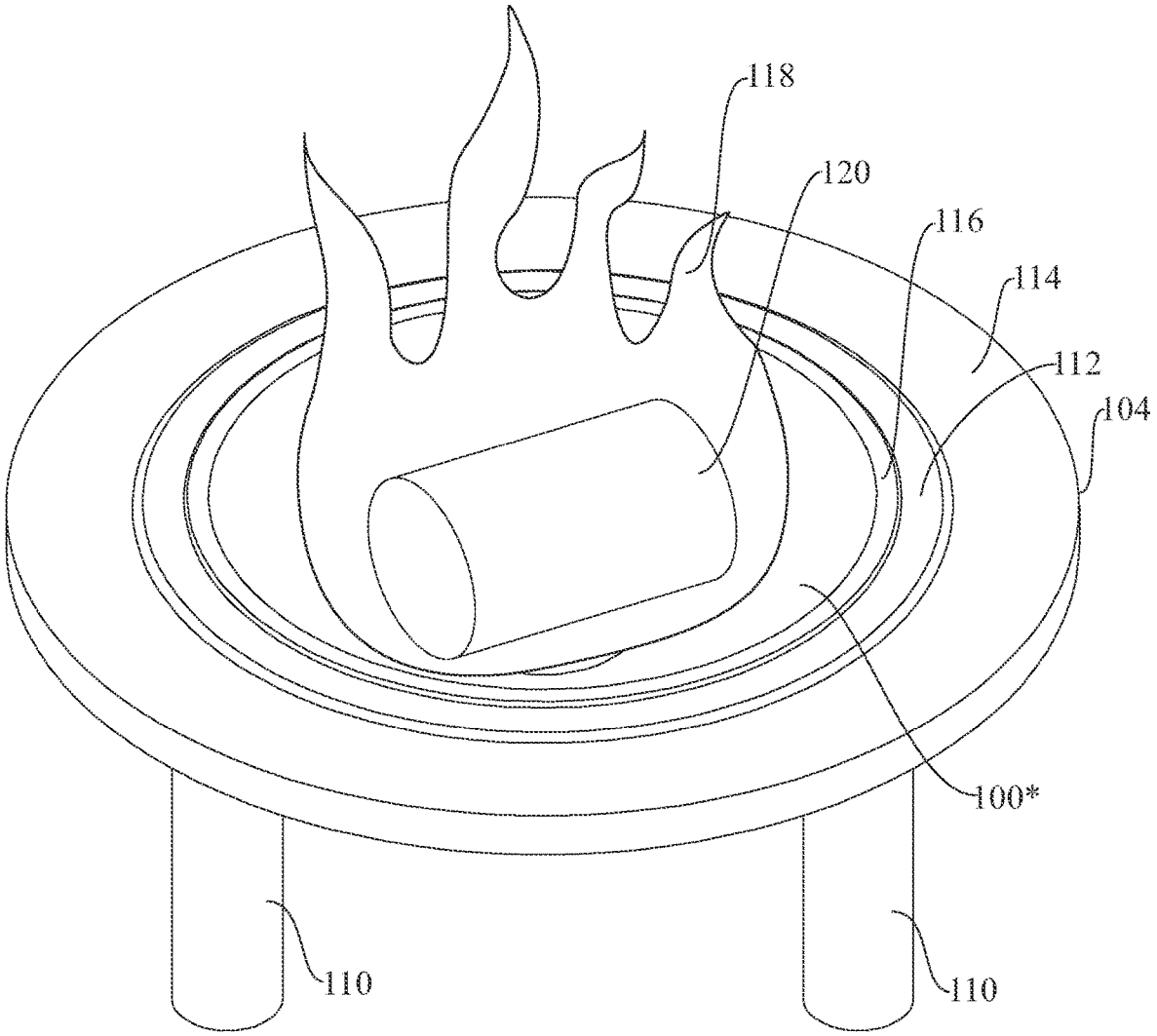
FIG. 6 presents a perspective view of the fire pit liner in the fire pit while a log is burned in the firepit.

Referring to FIGS. 4-6, there are provided illustrations of the circular flat metal paper 100 after it is pressed into the woodburning area 102 and formed into the non-expandable, uniform circular bowl-shaped fire pit liner 100*. The edge 116 of the non-expandable, uniform circular bowl-shaped fire pit liner 100* extend partially over the width "w" of the circular lip section 112 due to the greater diameter $D^L$ as compared to the diameter of the underlying wood burning area $D^P$/102. More specifically in FIG. 6, there is provided an illustration of a fire 118 burning a piece of wood 120 over the non-expandable, uniform circular bowl-shaped fire pit liner 100*.

Figure 7:
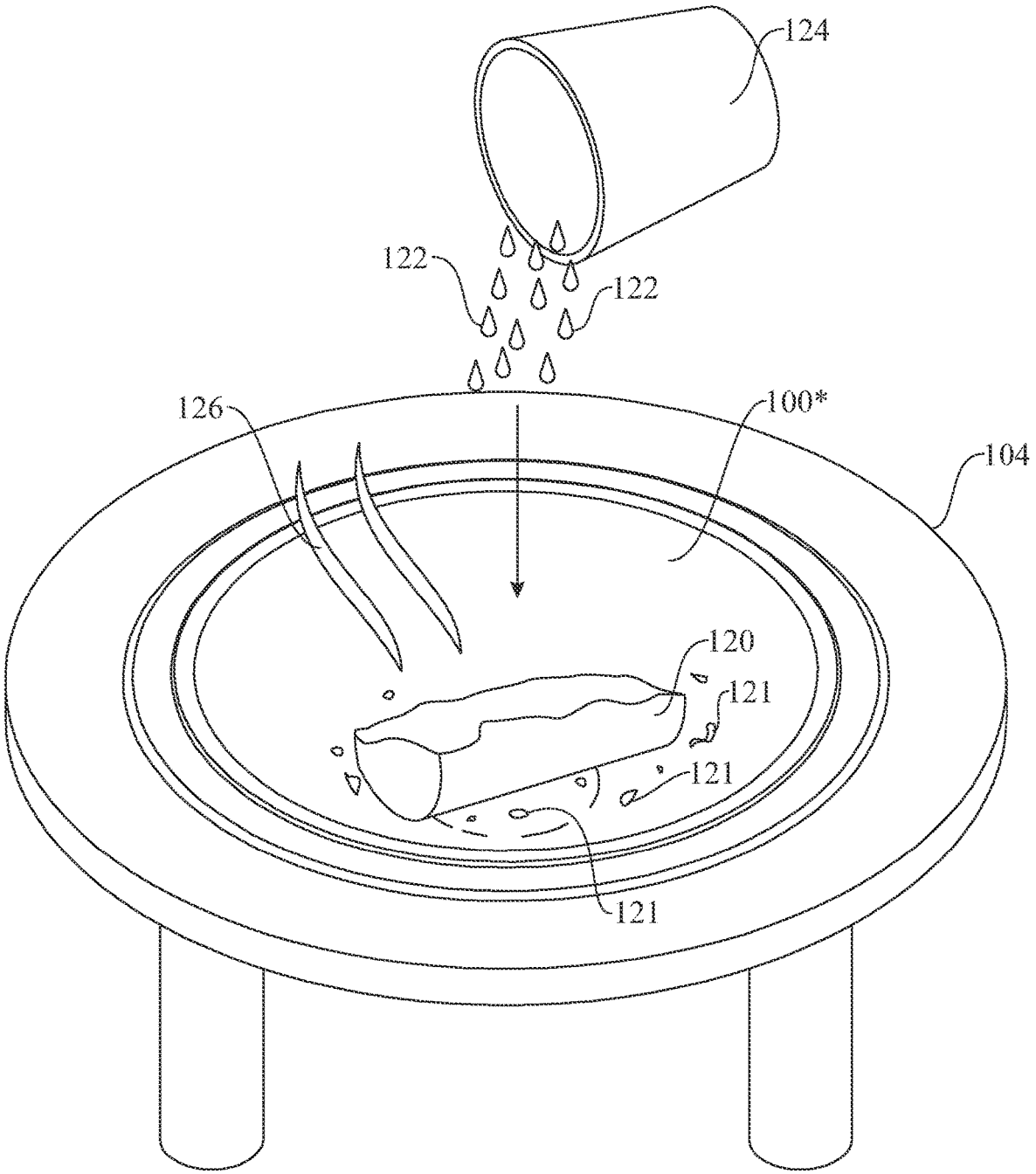
FIG. 7 presents a perspective view of the fire of FIG. 6 being extinguished with water which evaporates as steam; and, FIG. 8 presents a perspective view of the contents of the fire of FIG. 7 cinched into a bag.
Figure 8:
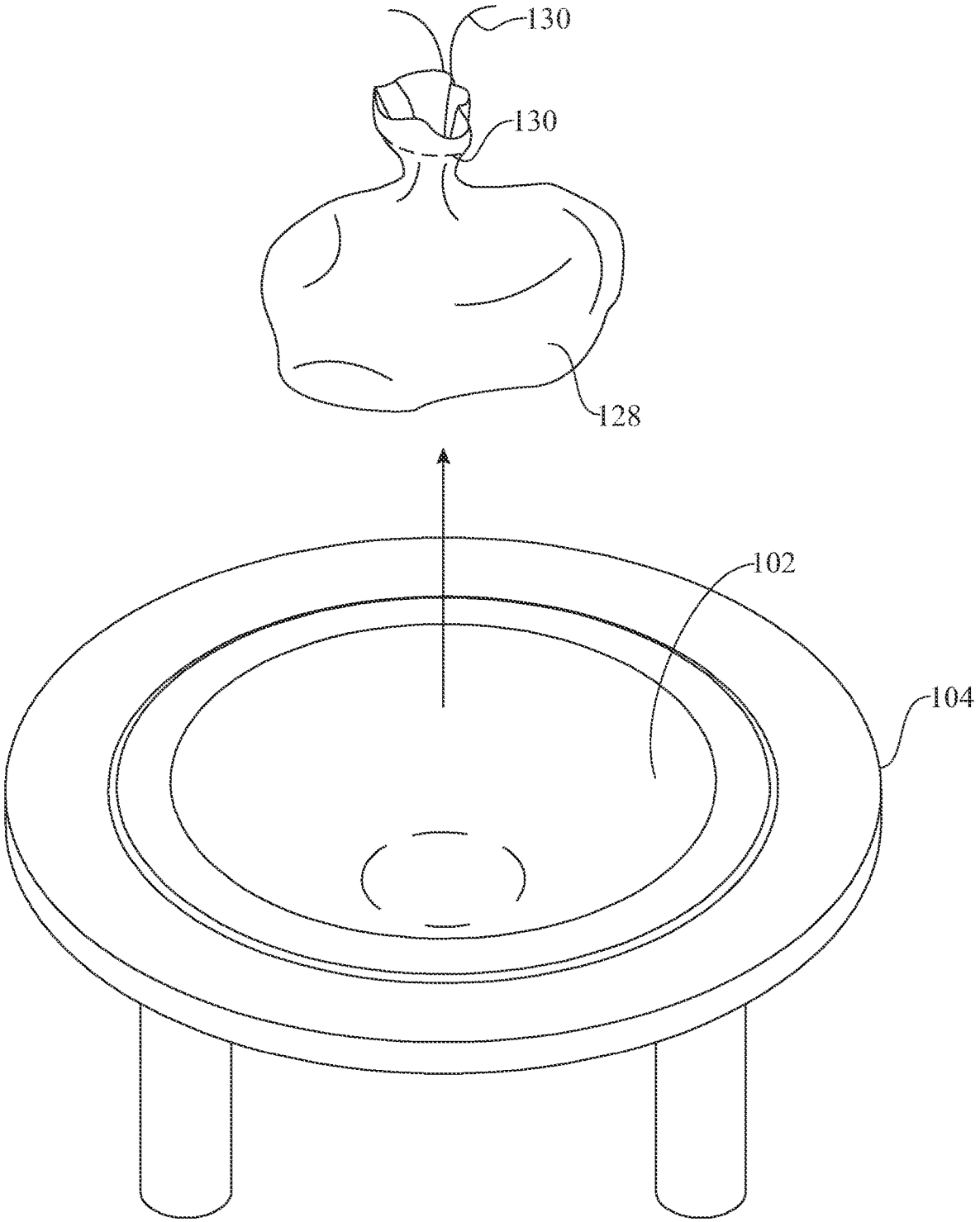

Referring to FIGS. 7-8, specifically in FIG. 7 there is provided an illustration of the fire pit 104 with the wood 120 being partially burned and ash debris 121 located therein and showing water 122 being poured from a bucket 124 over the wood 120 and steam 126 emanating therefrom. Specifically referring to FIG. 8, there is provided an illustration of the non-expandable, uniform circular bowl-shaped fire pit liner 100* of FIG. 7 being removed from the fire pit 104 with the wood 120 and ash debris (both not shown) being encapsulated in a bag/pouch 128 by grasping the several points of the edges of the non-expandable, uniform circular bowl-shaped fire pit liner 100* and cinching them together to form the bag/pouch 128 and then removing the bag/pouch 128 from the underlying wood burning area 102 in the direction of the upward arrow.

In an alternate embodiment, the non-expandable, uniform circular bowl-shaped fire pit liner 100* can be cinched into the bag/pouch 128 by use of a threaded threading material 130 as described herein, which can be used to tie off the bag/pouch 128 for easy and safe disposal.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A fire pit liner comprising a non-flammable material liner in a non-expandable uniform circular bowl-shape which is collapsible into the form of a bag, and wherein the fire pit liner has a non-flammable threading material threaded through a smaller circumference of the fire pit liner than the full circumference of the fire pit material and wherein the threading material is a metal material in a wire form which is of an increased strength compared to the strength of the fire pit liner material.

2. The fire pit liner of claim 1 wherein the non-flammable material liner is made of a material selected from the group consisting of metal, glass and ceramic.

3. The fire pit liner of claim 1, wherein the non-flammable material liner is a metallic paper made of tempered aluminum foil having a thickness within the gauge range of 0.001 inches to 0.005 inches and a tempering which is in the range of 50% to 100%.

4. The fire pit liner of claim 1 wherein the liner is circular and is configured to have a diameter which is larger than the diameter of the fire pit to which it is to be applied.

5. The fire pit liner of claim 1, wherein the size of the non-expandable uniform circular bowl-shaped fire pit liner has a depth of from about 2 inches to about 12 inches.

6. The fire pit liner of claim 1, wherein the non-expandable uniform circular bowl-shaped fire pit liner is formed by hand by pressing down on a flat circular fire pit liner material so as to conform the liner material to an interior concave surface of the underlying fire pit.

7. A fire pit system comprising:

a fire pit liner comprising a non-flammable material liner in a non-expandable uniform circular bowl-shape which is collapsible into the form of a bag; and, a fire pit, and wherein the fire pit liner has a non-flammable threading material threaded through a smaller circumference of the fire pit liner material than the full circumference of the fire pit material and wherein the threading is a metal material in a wire form which is of an increased strength compared to the strength of the fire pit liner material.

8. The fire pit system of claim 7, wherein the firepit is elevated by a number of legs.

9. The fire pit system of claim 7, wherein liner is configured in the fire pit as a protective cover to the underlying surface of a wood burning area of the fire pit.

10. The fire pit system of claim 7, wherein the uniform circular bowl-shaped fire pit liner is layered upon another underlying uniform circular bowl-shaped fire pit liner in a series of overlaid fire pit liners, the top layer of which is configured to be removed after one or more uses of the fire pit to expose the next unused fire pit liner.

11. The fire pit system of claim 7, wherein the threading material is selected from the group consisting of an aluminum, copper, steel, and brass wire of about 16-to-30-gauge wire.

12. The fire pit system of claim 7, wherein the threading material is a fire-resistant textile material made with any one or more of poly benzyl imidazole, aromatic polyamides, flame retardant cotton, coated nylon, phosphorus-containing natural or synthetic cords or ropes, melamine-containing cords or ropes, and modacrylic cords or ropes.

13. A method of operating a fire pit comprising:

(a) providing a fire pit;

(b) providing the fire pit liner of claim 1 to the fire pit;

(c) conducting a fire in the fire pit; and, (d) collapsing the fire pit liner into the shape of a bag.

14. The method of claim 13, wherein the step (b) of providing the fire pit liner comprises applying a flat circular metal paper material by pressing the metal paper material of the fire pit liner into the fire pit such that it is flush with the surface of the underlying fire pit.

15. The method of claim 13, wherein the step (d) of collapsing the fire pit liner into the shape of a bag comprises either cinching circumferential edge points of the non-expandable, uniform circular bowl-shaped fire pit liner, or pulling the metal material in a wire form which is of an increased strength compared to the strength of the fire pit liner material, and which has been threaded through the smaller circumference of the fire pit liner, in order to cinch the fire pit liner.

16. The method of claim 13, further comprising discarding the fire pit liner in the form of a pouch.

17. A method of operating a fire pit comprising:

(a) providing a fire pit;

(b) providing a fire pit liner comprising a non-flammable material liner in a non-expandable uniform circular bowl-shape which is collapsible into the form of a bag to the fire pit and wherein the fire pit liner has a non-flammable threading material threaded through a smaller circumference of the fire pit liner material than the full circumference of the fire pit material and wherein the threading material is a metal material in a wire form which is of an increased strength compared to the strength of the fire pit liner material;

(c) conducting a fire in the fire pit; and, (d) collapsing the fire pit liner into the shape of a bag.

18. The method of claim 17, wherein the step (d) of collapsing the fire pit liner into the shape of a bag comprises either cinching circumferential edge points of the non-expandable, uniform circular bowl-shaped fire pit liner, or pulling the metal material in a wire form which is of an increased strength compared to the strength of the fire pit liner material, and which has been threaded through the smaller circumference of the fire pit liner, in order to cinch the fire pit liner.

* * * * *